US005316613A

United States Patent [19]

Samuelson et al.

[11] Patent Number: 5,316,613

[45] Date of Patent: May 31, 1994

[54] DEFINITE LENGTH TRANSFER ADHESIVE DISPENSER

[75] Inventors: Bruce E. Samuelson, Stillwater; Susan M. Butzer, Eagan, both of Minn.

[73] Assignee: Minnesota Mining and Manufacturing Company, St. Paul, Minn.

[21] Appl. No.: 755,660

[22] Filed: Sep. 6, 1991

[51] Int. Cl.[5] ..... B32B 31/00

[52] U.S. Cl. ..... 156/540; 156/577; 156/579; 156/234; 156/238

[58] Field of Search ..... 156/540, 577, 579, 584, 156/574, 385, DIG. 48, DIG. 51, 234, 238

[56] References Cited

U.S. PATENT DOCUMENTS

| | | | |
|---|---|---|---|
| Re. 28,010 | 5/1974 | Way . | |
| 998,164 | 7/1911 | Feist | 156/DIG. 48 |
| 2,891,692 | 6/1959 | Fronman . | |
| 3,271,227 | 9/1966 | Jaeckel | 156/541 X |
| 3,308,003 | 3/1967 | Hurwich et al. . | |
| 3,691,140 | 9/1972 | Silver . | |
| 3,745,083 | 7/1973 | Aungst et al. | 156/385 X |
| 3,765,992 | 10/1973 | Stageberg . | |
| 3,857,731 | 12/1974 | Merrill, Jr. et al. . | |
| 3,969,181 | 7/1976 | Seabold | 156/577 |
| 4,255,218 | 3/1981 | Stageberg . | |
| 4,345,966 | 8/1982 | Iiyama et al. | 156/523 |
| 4,466,855 | 8/1984 | Kashiwaba | 156/DIG. 48 |
| 4,636,276 | 1/1987 | Nozaka | 156/577 X |
| 4,718,971 | 1/1988 | Summers | 156/540 |
| 4,762,586 | 8/1988 | Wilkie . | |
| 4,891,090 | 1/1990 | Lorinez et al. . | |
| 4,904,334 | 2/1990 | Honma et al. | 156/540 |
| 4,980,011 | 12/1990 | Gruber | 156/238 X |
| 4,994,322 | 2/1991 | Delgado et al. . | |
| 5,000,815 | 3/1991 | Hanna | 156/DIG. 48 |
| 5,150,851 | 9/1992 | Manusch et al. | 242/68.1 |

FOREIGN PATENT DOCUMENTS

| | | |
|---|---|---|
| 2008820 | 7/1990 | Canada . |
| 0270736 | 6/1988 | European Pat. Off. . |
| 0368078 | 5/1990 | European Pat. Off. . |
| 0380978 | 8/1990 | European Pat. Off. . |
| 3109735 | 3/1981 | Fed. Rep. of Germany . |

OTHER PUBLICATIONS

IBM Technical Disclosure Bulletin, vol. 18, No. 7, Dec. 1975.

International Search Report dated Dec. 14, 1992.

*Primary Examiner*—David A. Simmons
*Assistant Examiner*—Chester T. Barry
*Attorney, Agent, or Firm*—Gary L. Griswold; Walter N. Kirn; Jeffrey J. Hohenshell

[57] ABSTRACT

A definite length transfer adhesive dispenser is described. The dispenser provides a convenient, hand held device that repeatedly provides a definite length of adhesive. The dispenser may be used to provide a spot of adhesive in a scrapbook or photo album. An adhesive for use with the dispenser is also described.

30 Claims, 4 Drawing Sheets

DEFINITE LENGTH TRANSFER ADHESIVE DISPENSER

TECHNICAL FIELD

The present invention relates generally to dispensers for transfer adhesives and more particularly to dispensers which apply predetermined lengths of transfer adhesive to a substrate.

BACKGROUND

"Transfer Adhesive" as used herein is defined as an adhesive which is originally carried by a liner or backing and which is subsequently separated from the liner and adhered to a substrate.

The art is replete with hand-held transfer adhesive dispensers which dispense an indefinite length of transfer adhesive. U.S. Pat. Nos. 4,718,971 and 4,891,090 are examples of such indefinite length dispensers.

Indefinite length transfer adhesive dispensers have a variety of uses. For example, such dispensers may be used to place adhesive on a page in a scrapbook or photo album so that a photograph or other memorabilia may be adhered to the page.

Generally, indefinite length transfer adhesive dispensers comprise a supply reel and tape roller, and a trigger. To operate the dispenser, the trigger is actuated and the dispenser is pressed against a substrate and then drawn across the substrate. Trigger operated dispensers are difficult to use for some operators as a number of coordinated movements are necessary to apply the adhesive to the substrate.

In some uses of transfer adhesive, such as adhering a photo or other memorabilia to a page in a scrapbook or photo album, it is desirable to use only a relatively small "spot" or definite length of adhesive. With indefinite length adhesive dispensers, some users find it difficult to judge the amount of adhesive being applied to a surface and as a result may waste some of the adhesive, or may require repeated applications of the adhesive to the substrate.

U.S. Pat. Nos. 3,765,992 and 4,255,218 describe methods and apparatus for applying an adhesive strip to an envelope. Such mechanisms are complex mechanisms and are large relative to a hand held dispenser.

DISCLOSURE OF THE INVENTION

The present invention provides a convenient, hand held definite length transfer adhesive dispenser for applying a "spot" or predetermined length of a transfer adhesive to a substrate from a supply roll of the transfer adhesive. The present invention provides a dispenser which (1) is easily and conveniently used without the need to coordinate a number of operations, (2) provides a definite length of adhesive to a substrate without unnecessary additional effort by a user, (3) repeatedly provides a reproducible length of transfer adhesive to a substrate, and (4) reduces waste of transfer adhesive.

The supply roll of transfer adhesive comprises a supply core and a through opening defined by a cylindrical inner surface, and a length of backing strip wound around the supply core. The backing strip has first and second major surfaces with the transfer adhesive releasably attached to the first major surface and with the second major surface coated with a release material by methods known in the art.

The transfer adhesive dispenser comprises a housing having a base wall, side walls, surfaces defining an open end, an outer surface adapted to be manually grasped, and a supply roll hub having an arcuate periphery.

The inner surface of the supply core is journaled on the periphery of the supply roll hub, and the dispenser includes a mechanism for restricting free rotation of the supply roll about the hub comprising the supply roll hub being a generally flexible arcuate member that is radially movable between (1) a relaxed position where the supply roll hub has a diameter generally slightly greater than the diameter of the inner surface of the supply core, and (2) a loaded position with the supply core journaled on the supply roll hub with the peripheral surface of the supply roll hub in frictional engagement with the inner surface of the supply core to restrict movement of the supply core. The stiffness of the supply roll hub biases the peripheral surface of the supply roll hub into frictional engagement with the inner surface of the supply core when the supply roll hub is in the loaded position.

The transfer adhesive dispenser also comprises a take-up assembly including a take-up hub having an arcuate periphery; and a take-up core journaled on the periphery of the take-up hub and having a portion of the backing strip wound thereon after application of the adhesive to the substrate. The take-up core rotates about the take-up hub in an advancing direction. Path means define a path for the backing strip from the supply roll hub to the take-up hub.

The dispenser includes application means comprising an application member including an application surface. The application surface forms a length of the path for the backing strip, and is adapted to engage the release material or second surface of the backing strip.

An actuation member is mounted for manually actuated reciprocal movement relative to the housing between a projecting position with a distal surface projecting past the open end of the housing to afford positioning the application surface opposite a substrate and a retracted position with the application surface and the distal surface of the actuation member generally aligned so that the predetermined length of transfer adhesive on the backing strip may be pressed into contact with the substrate positioned opposite the application surface.

Advancing means are coupled between the actuation member and the take-up assembly for advancing the predetermined length of the backing strip and the transfer adhesive along the path to position the predetermined length of adhesive strip along the application surface.

In operation, upon movement of the actuation member from the projecting position to the retracted position, the advancing means advances the predetermined length of the backing strip and the transfer adhesive along the path to position the predetermined length of adhesive strip along the application surface. The application surface may be manually pressed against the substrate by manual pressure on the housing. When the application surface is manually pressed against the substrate, the transfer adhesive is pressed against the substrate and adheres to the substrate. Upon movement of the actuation member from the retracted position to the projecting position, the transfer adhesive that was pressed against the substrate tears from the backing strip and adheres to the substrate.

Preferably, the path means comprises a guide member having a land surface projecting from the base wall. Also preferably the dispenser includes biasing means such as a coil or a torsion spring for biasing the actuation member toward the projecting position.

In a first embodiment of dispenser according to the present invention, the advancing assembly comprises an elongate drive member having a first end attached to the actuation means and a second engagement end. The take-up core is generally cylindrically-shaped and has a plurality of generally radially projecting drive ribs. Means mount the elongate drive member on the housing to reciprocably move from (1) a release position with the second engagement end spaced from the radially projecting drive ribs to (2) an engage position between which release and engage positions the second engagement end is adapted to engage one of the drive ribs and rotate the take-up core to advance the length of the backing strip and the transfer adhesive a predetermined length along the path. When the actuation member is moved from the projecting position to the retracted position, the elongate drive member moves from the release to the engage position.

Guide means are mounted on the housing for guiding the engagement end of the drive member into engagement with a drive rib upon movement from the release to the engage position and for preventing engagement between the engagement end and the radially projecting drive ribs when the elongate drive member moves from the engage position toward the release position.

The first embodiment of dispenser according to the present invention also includes arresting means comprising the take-up core having a ratchet having specially shaped ratchet teeth attached thereto, the housing having an integral pawl. The pawl has an engagement end for engaging the specially shaped ratchet teeth for arresting rotation of the take-up core in a direction other than the advancing direction and for affording intermittent movement of the take-up core in the advancing direction. The arresting means restricts backlash of the backing strip.

In a second embodiment of dispenser according to the present invention the advancing means comprises an elongate drive member having a first end attached to the actuation means and a second engagement end, and the dispenser housing includes arcuate gear bearing surfaces. The second embodiment of dispenser includes an eccentric orbital gear system comprising a drive gear journaled on the arcuate gear bearing surfaces and having a plurality of generally radially outwardly projecting drive ribs, and radially inwardly projecting teeth, a driven pinion gear attached to the take-up core and having an axis offset from the axis of the gear bearing surfaces and radially outwardly projecting teeth adapted to engage the teeth of the drive gear.

In the second embodiment of dispenser according to the present invention, the advancing means comprises means mounting the elongate drive member on the housing to reciprocably move from (1) a release position with the second engagement end spaced from the radially projecting drive ribs to (2) an engage position between which release and engage positions the second engagement end is adapted to engage one of the ribs of the drive gear which rotates the driven pinion gear which in turn rotates the take-up core to advance the length of the backing strip and the transfer adhesive a predetermined length along the path. Since the drive member is attached to the actuation member, when the actuation member is moved from the projecting position to the retracted position, the elongate drive member moves from the release to the engage position.

Like the first embodiment of dispenser according to the present invention, the second embodiment of dispenser according to the present invention includes guide means similar to the guide means in the first embodiment and arresting means. However, the arresting means of the second embodiment comprises the drive gear having a ratchet having specially shaped ratchet teeth, the housing having a pawl with a distal engagement end for engaging the specially shaped ratchet teeth for arresting rotation of the drive gear in a direction other than a direction which moves the supply core in the advancing direction and for affording intermittent movement of the take-up core in the advancing direction. Optionally the take-up hub may have a friction brake operatively connected thereto to further restrict backlash of the backing.

BRIEF DESCRIPTION OF THE DRAWING

The present invention will be further described with reference to the accompanying drawing wherein like reference numerals refer to like parts in the several views, and wherein:

FIGS. 4 through 6 sequentially illustrate movement of the take-up assembly and advancing means of the dispenser of FIG. 1 wherein:

FIG. 4 is an enlarged, elevational partially fragmented sectional view which illustrates the actuation member in the projecting position;

FIG. 5 is an enlarged, elevational partially fragmented sectional view of the upper portion showing the advancing means advancing the backing strip by engaging the take-up assembly;

FIG. 6 is an enlarged elevational partially fragmented sectional view illustrating the actuation member in the retracted position and illustrating the position of the dispenser when the adhesive may be pressed against the substrate;

FIGS. 11–13 sequentially illustrate movement of the take-up assembly and advancing means of the dispenser of FIG. 9 wherein:

FIG. 11 is an elevational partially fragmented front sectional view which illustrates the actuation member in the projecting position;

FIG. 12 is an elevational partially fragmented rear sectional view showing the advancing means advancing the backing strip by engaging the take-up assembly;

FIG. 13 is an enlarged elevational partially fragmented rear sectional view illustrating the actuation member in the retracted position and illustrating the position of the dispenser when the adhesive may be pressed against the substrate.

DETAILED DESCRIPTION

Figure 1:
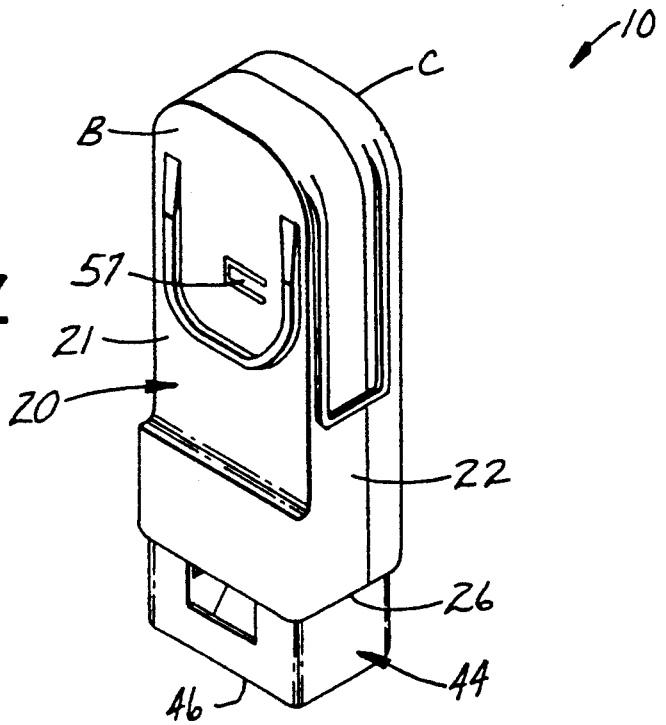
FIG. 1 is a perspective view of a first embodiment of definite length dispenser according to the present invention.
Figure 2:
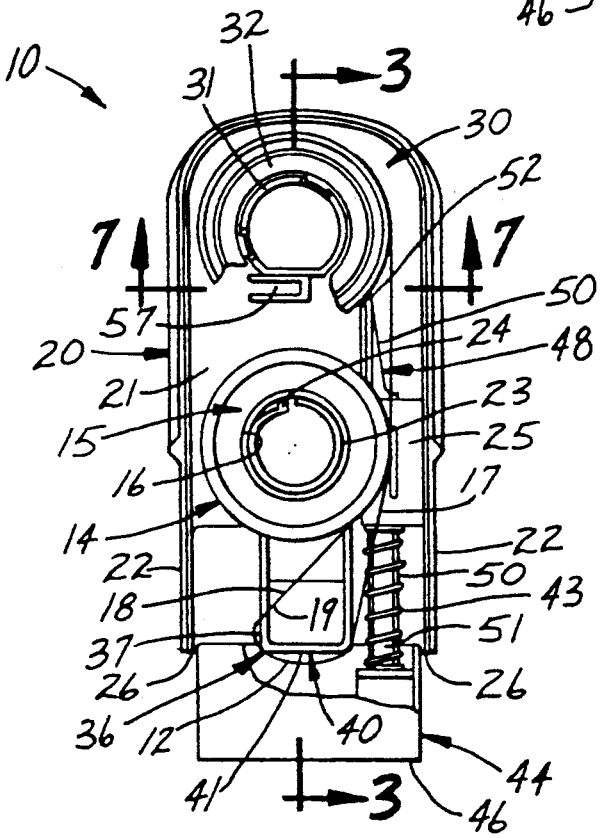
FIG. 2 is an elevational partially fragmented sectional view of the dispenser of FIG. 1.
Figure 3:
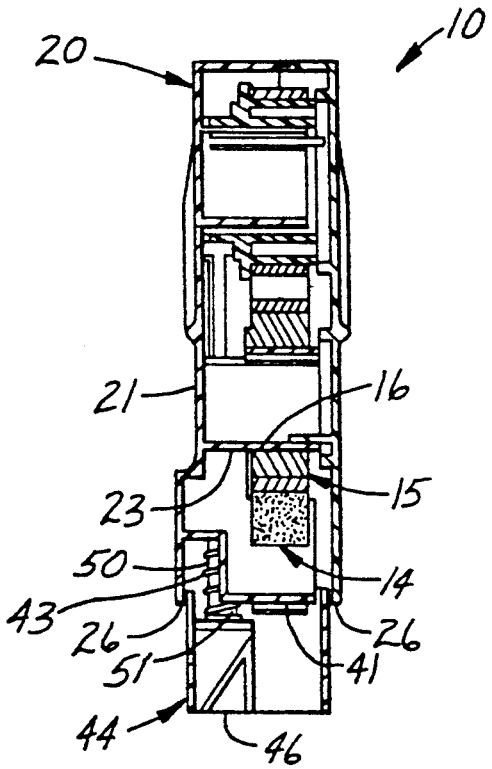
FIG. 3 is a sectional view of the dispenser of FIG. 1 taken approximately along line 3—3 of FIG. 2.

Referring now to FIGS. 1 through 8 of the drawing, there is shown a first embodiment of a hand held definite length transfer adhesive dispenser according to the present invention generally designated by the reference number 10. The dispenser 10 is adapted to apply a "spot" or predetermined length of a transfer adhesive 12 to a substrate (not shown) from a supply roll 14 of the transfer adhesive 12 comprising a supply core 15 having a through opening defined by a cylindrical inner surface 16 having an inner diameter of approximately 2.62 centimeters (1.030 inches), and a length of backing strip 17 wound around the supply core 15. The backing strip 17 has first 18 and second 19 major surfaces with the transfer adhesive releasably attached to the first major surface 18 and with the surfaces 18 and 19 coated with a release means or material prepared by methods known in the art. For example, the release material on surfaces 18 and 19 may comprise a low adhesion backsize.

The transfer adhesive 12 may comprise any suitable transfer adhesive that will cleanly break or fracture and separate from the backing 17. "Cleanly breaking" is defined herein as a separation of a portion of the adhesive 12 (the predetermined length) from the backing 17 and the remaining portion of the adhesive without excessive extraneous fibers or strings of adhesive trailing from the edges of the transferred adhesive. For example the transfer adhesive may comprise a pressure sensitive adhesive comprising infusible, solvent dispersible, solvent-insoluble, inherently tacky, elastomeric copolymer microspheres which consist essentially of about 90 percent to about 99.5 percent by weight of at least one alkyl acrylate ester and about 10 to about 0.5 percent by weight of at least one monomer selected from the group consisting of substantially oil-insoluble, water soluble ionic monomers and maleic anhydride.

The copolymer microspheres are small in size, and have diameters in the range of about 1 to about 250 microns. The diameter of a majority of the spheres fall in the range of about 5 to about 150 microns. Polymeric microsphere adhesives are disclosed for example, in U.S. Pat. No. 3,691,140, the entire contents of which are herein expressly incorporated by reference. Although the above microspheres are preferred, it is also contemplated that hollow microsphere adhesives may be used that are repositionable pressure-sensitive adhesives comprising from about 70 percent to about 99 percent hollow, polymeric, acrylate, inherently tacky, infusible, solvent insoluble, solvent-dispersible, elastomeric microspheres comprising at least one alkyl acrylate or alkyl methacrylate ester, a majority of the microspheres having one or more interior voids having a diameter of at least about 10 percent of the diameter of the microsphere, and correspondingly, from about 1 percent to about 30 percent of binder copolymer comprising an elastomeric polymeric backbone having pendant high Tg polymeric moieties. These hollow microspheres are normally tacky, elastomeric, insoluble but are swellable in organic solvents. The microspheres typically have diameters of at least about 1 micron, and preferably diameters in the range of about 1 to about 250 microns. The voids typically range in size up to about 100 microns or larger. Hollow polymeric microsphere adhesives are disclosed, for example in U.S. Pat. No. 4,994,322, the entire contents of which are herein expressly incorporated by reference.

The above mentioned microsphere adhesives have been found to provide an effective transfer adhesive when used alone or with a film forming acrylate adhesive such as an adhesive having 95 parts of isooctyl acrylate and 5 parts acrylic acid. When the microsphere adhesive is used in combination with a film forming adhesive, a range of from about 1 to about 30 parts of film forming adhesive may be used. Preferably a blend of microsphere adhesive to acrylic adhesive is 90 parts microsphere adhesive to about 10 parts acrylic or film forming adhesive. When coated onto the release side 19 of the backing 17 or liner, a preferred coating weight of 25 grams of coating per square meter was found to be easily transferred while maintaining a sufficient amount of adhesion to properly adhere a photograph to a paper substrate. The adhesive blend may be coated onto a silicone liner or backing such as the liner designated as 2-60BKG-157-99AM, available from the Daubert Company of Oak Brook, Ill. The blend has been found to be particularly useful for mounting photographs.

Although the above adhesive blends were preferred, additional adhesives may be utilized such as tackified rubber-based resins available as the KRATON rubbers from the Shell Chemical Company of Oak Brook, Ill., and film forming alkyl acrylate copolymers such as those described in U.S. Pat. No. 3,857,731, the entire contents of which are also herein expressly incorporated by reference. When these adhesives are utilized, additional materials should be added to render the adhesive frangible.

A frangible adhesive is defined as an adhesive which is readily or easily broken apart or fractured from its matrix or render the adhesive frangible. In the case of the microsphere/acrylate blends, the microspheres act as a frangible agent to render the adhesive frangible. When the adhesive is free of microspheres; ceramic, glass or polymeric spheres, bubbles or fibers may alternatively be used to impart the frangible characteristic or nature to the adhesive. Alternatively, when a non-frangible adhesive (e.g. an adhesive which does not readily separate from itself) is used, pattern coating techniques may be used to coat the non-frangible adhesive onto a liner so that a definite length of the adhesive transfers to the substrate.

The dispenser 10 comprises a housing 20 having a housing axis A (FIG. 4), a base wall 21, side walls 22, and surfaces defining an open end 26. The housing 20 may comprise a polygonal structure having a width of 6.35 centimeters (2.500 inches), a height of approximately 15.24 centimeters (6.00 inches) and a thickness of approximately 3.18 centimeters (1.250 inches). The housing may be constructed from any suitable material such as a metal or plastic including but not limited to polyester, ABS plastic, polystyrene or polypropylene.

Preferably the housing 20 is formed in two pieces including a base portion B and a cover portion C. The base portion B and cover portion C have cooperable grooves and flanges which afford a removable press-fit attachment of the base B to the cover C portion. Removal of the cover portion C affords access to the inner surfaces of the housing 20 so that a user may replace a depleted supply roll 14 with a replacement supply roll.

The housing 20 has an outer surface adapted to be manually grasped (FIG. 1), a supply roll hub 23 having an arcuate periphery and axially spaced ends with one of the ends being fixed to the base wall 21. The inner surface 16 of the supply core 15 is journaled on the periphery of the supply roll hub 23, and the dispenser 10 includes a mechanism for restricting free rotation of the supply roll 14 about the supply roll hub 23 comprising the supply roll hub 23 being a generally flexible arcuate member that is radially movable between (1) a relaxed position where the supply roll hub 23 has a diameter generally slightly greater than the diameter of the inner surface 16 of the supply core 15, and (2) a loaded position (FIG. 2) with the supply core 15 journaled on the supply roll hub 23 with the peripheral surface of the supply roll hub 23 in frictional engagement with the inner surface of the supply core 15 to restrict free rotation of the supply core 15. The stiffness of the supply roll hub 23 biases the peripheral surface of the supply roll hub 23 into frictional engagement with the inner surface of the supply core 15 when the supply roll hub 23 is in the loaded position. Preferably, a friction projection 24 may be present to fictionally engage the inner surface of the supply core 15 to restrict free rotation of the supply roll 14.

The dispenser 10 also comprises a take-up means or assembly 30 including the housing 20 having a take-up hub 31 having an arcuate periphery, and axially spaced ends with one of the ends being fixed to the base wall 21. The take-up assembly 30 includes a take-up core 32 having cylindrical inner surfaces having an inner diameter of approximately 3.81 centimeters (1.500 inches). The take-up core 32 is journaled on the periphery of the take-up hub 31 and has a portion of the backing strip 17 wound thereon after application of the adhesive 12 to the substrate.

The take-up core 32 rotates about the take-up hub 31 in an advancing direction. Path means define a path for the backing strip 17 from the supply roll hub 23 to the take-up hub 31. Preferably, the path means comprises a guide member 36 having a land surface 37 projecting from the base wall 21 with a first end fixed to the base wall and a second end remote from the base wall 21.

Application means are present and comprise an application member 40 including an application surface 41 (e.g. a rectangular surface having a width of 1.91 centimeters or 0.75 inches) having a first end fixed to the base wall 21 and a second end remote from the base wall 21. The application surface 41 forms a length of the path for the backing strip 17, and is adapted to engage the release material or low adhesion backsize surface 19 of the backing strip 17.

An actuation member 44 is mounted for manually actuated reciprocal movement relative to the housing 20 between a projecting position (FIG. 4) with a distal surface 46 projecting past the open end 26 of the housing 20 to afford positioning the application surface 41 opposite a substrate and a retracted position (FIG. 6) with the application surface 41 and the distal surface 46 of the actuation member 44 generally aligned so that the predetermined length of transfer adhesive 12 on the backing strip 17 may be pressed into contact with the substrate positioned opposite the application surface 41. The actuation member 44 is preferably constructed from a transparent polymeric material. A user may see the substrate through this portion of the dispenser 10 to afford easy, convenient positioning the application surface 41 opposite a substrate. Optionally, visual indicia such as arrows may be printed on the actuation member to further assist in locating the adhesive "spot" on the substrate.

The dispenser 10 also includes advancing means 48 coupled between the actuation member 44 and the take-up assembly 30 for advancing the predetermined length of the backing strip 17 and the transfer adhesive 12 along the path to position the predetermined length of adhesive strip 17 along the application surface 41.

In the first embodiment of dispenser according to the present invention, the advancing means or assembly 48 comprises a flexible elongate drive member 50 having a first end 51 attached to the actuation member 44 and a T-shaped second engagement end 52. The take-up core 32 is generally cylindrically-shaped and has a plurality of generally radially projecting drive ribs 54 adapted to engage the end 52 of the drive member 50.

Means such as a sleeve portion 25 of housing 20, mount the elongate drive member 50 on the housing for reciprocal movement relative to the housing 20 between (1) a release position (FIG. 4) with the second engagement end 52 spaced from the radially projecting drive ribs 54 and (2) an engage position between which release and engage positions the second engagement end 52 is adapted to engage one of the drive ribs 54 (FIG. 5) and rotate the take-up core 32 to advance the length of the backing strip 17 and the transfer adhesive 12 a predetermined length along the path. A detent surface on sleeve portion 25 fits into a groove surface on the drive member 50 to limit the movement of the drive member 50 relative to the housing 20.

Figure 4:
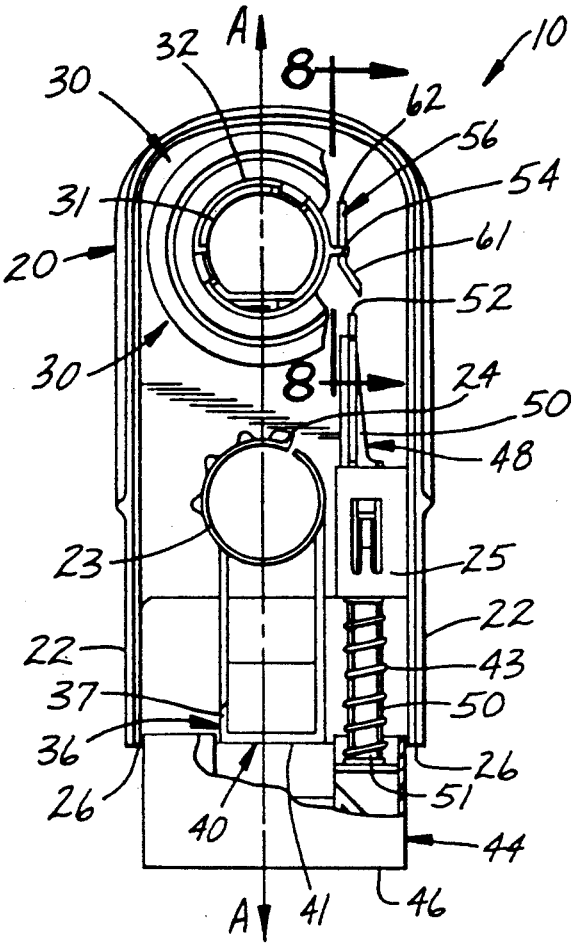

Also preferably the dispenser 10 includes biasing means such as a coil spring 43 for biasing the actuation member 44 toward the projecting position. As best seen in FIG. 4, one end of the spring 43 contacts the sleeve portion 25 and the other end of the spring contacts the actuation member 44.

Figure 6:
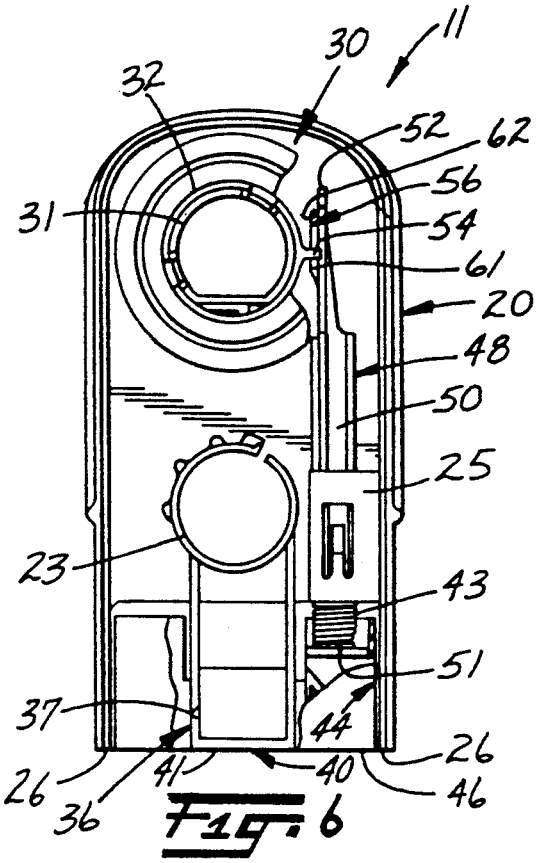
Figure 7:
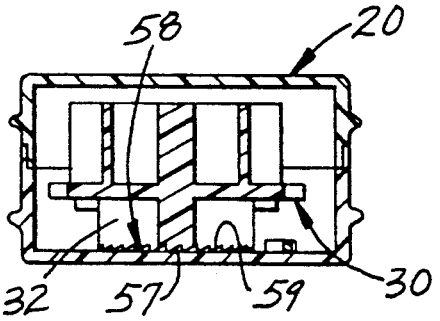
FIG. 7 is an enlarged sectional view of the dispenser of FIG. 1 taken approximately along line 7—7 of FIG. 2.
Figure 5:
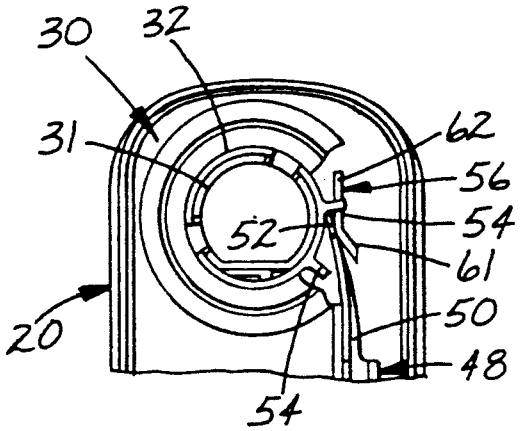
Figure 8:
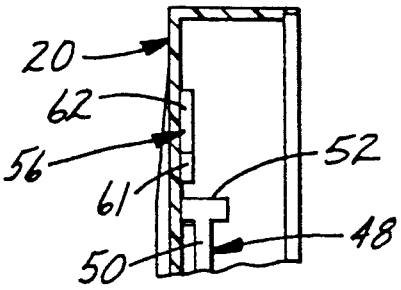
FIG. 8 is an enlarged partially fragmented detailed sectional view of the dispenser of FIG. 1 taken approximately along line 8—8 of FIG. 4 illustrating a guide mechanism.
Figure 9:
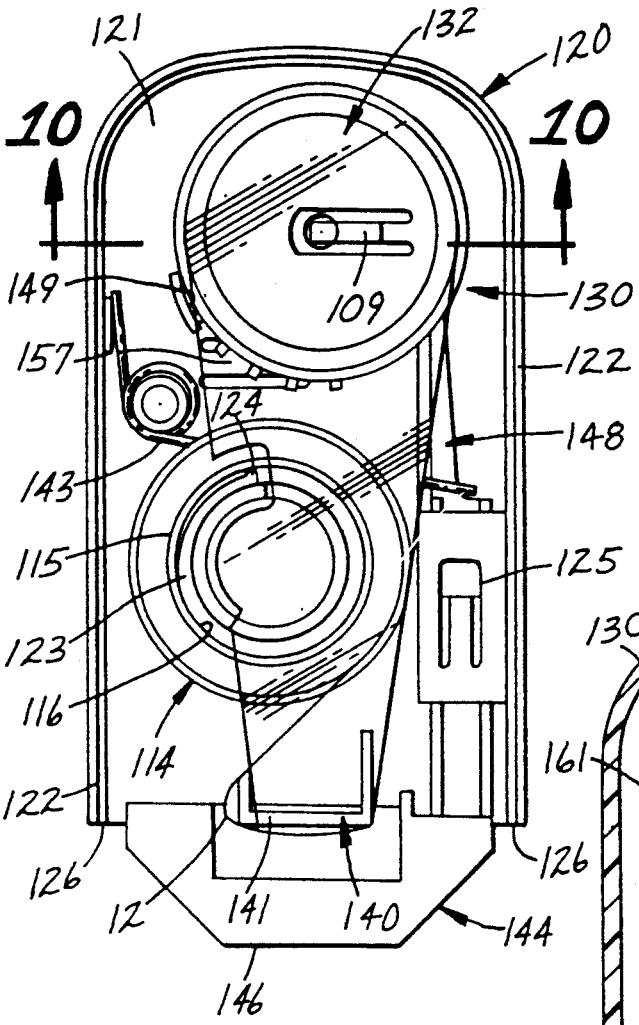
FIG. 9 is an elevational partially fragmented rear sectional view of a second embodiment of definite length transfer adhesive dispenser according to the present invention.
Figure 10:
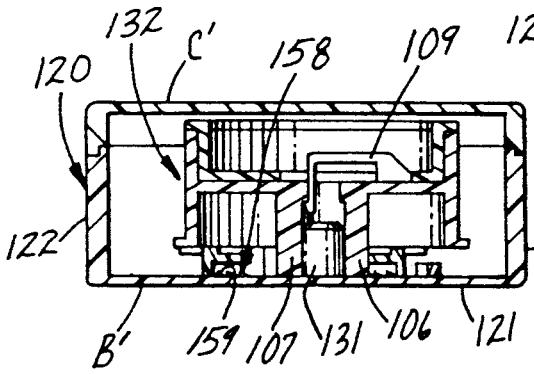
FIG. 10 is a sectional view of the dispenser of FIG. 9 taken approximately along line 10—10 of FIG. 9.

FIGS. 4 through 6 sequentially illustrate movement of the take-up assembly 30 and drive member 50 of the dispenser 10. When the actuation member 44 is moved from the projecting position toward the retracted position, the elongate drive member 50 moves from the release toward the engage position. A guide means such as an engagement shoulder 56 is mounted on the housing 20 and comprises first 61 and second 62 portions. The first portion 61 of the shoulder 56 engages a portion of the T-shaped end 52 and cams the T-shaped end 52 of the drive member 50 toward the drive ribs 54 and guides the end 52 into engagement with a drive rib 54 (FIG. 5). As the T-shaped end 52 is engaged with a rib 54 and moves along the first and second portions 61 and 62, the take-up core 32 rotates and advances the backing 17 the predetermined length. When the first portion 61 of the shoulder 56 cams the end 52 of the drive member 50 toward the drive ribs 54, the stiffness of the drive member 50 biases the end 52 away from the drive rib 54. Once the T-shaped end 52 of the drive member 50 passes the second portion 62, the stiffness of the member 50 causes the T-shaped end 52 to "spring" to the side of the shoulder 56 which is opposite the side facing ribs 54. After the T-shaped end 52 passes the second portion 62 of the shoulder 56, the shoulder 56 prevents engagement between the end 52 and the radially projecting drive ribs 54 when spring 43 causes the elongate drive member 50 to move back to the release position.

Optionally, the first embodiment of dispenser according to the present invention includes arresting means comprising the take-up core 32 having a ratchet 58 having specially shaped ratchet teeth 59 attached thereto. The housing 20 has a pawl 57 attached thereto. The pawl 57 has an engagement end for engaging the specially shaped ratchet teeth 59 for arresting rotation of the take-up core 32 in a direction other than the advancing direction and for affording intermittent movement of the take-up core 32 in the advancing direction. The arresting means restricts backlash of the backing strip 17.

Referring now to FIGS. 9 through 14 of the drawing, there is shown a second alternative embodiment of dispenser according to the present invention generally designated by the reference number 100 which has many parts that are essentially the same as the parts of the dispenser 10. The dispenser 100 is smaller than the dispenser 10, is more readily manipulated by a user and requires less storage space.

The dispenser 100 is adapted to apply a "spot" of adhesive 12 to a substrate (not shown) from a supply roll 114 of the transfer adhesive 12 comprising a supply core 115 having a through opening defined by a cylindrical inner surface 116 having an inner diameter of approximately 2.62 centimeters (1.030 inches), and a length of backing strip 17 wound around the supply core 115. The backing strip 17 has first 18 and second 19 major surfaces with the transfer adhesive 12 releasably attached to the first major surface 18 and with the second major surface 19 coated with a release means or material.

Like the dispenser 10, the dispenser 100 includes a housing 120 having a housing axis A' (FIG. 12), a base wall 121, side walls 122, and surfaces defining an open end 126. Like the housing 20, the housing 120 may comprise a polygonal structure, however, unlike the housing 20 the housing 120 is smaller and more easily maneuvered by a user. For example, the housing 120 may have a width of 5.46 centimeters (2.150 inches), a height of approximately 11.94 centimeters (4.700 inches) and a thickness of approximately 2.29 centimeters (0.900 inches). The housing 120 may be constructed from a material similar to the material used to construct housing 20.

Preferably the housing 120 is formed in two pieces including a base portion B' and a cover portion C'. The base portion B' and cover portion C' have cooperable grooves and flanges which afford a removable press-fit attachment of the base B' to the cover C' portion. Removal of the cover portion C' affords access to the inner surfaces of the housing 120 so that a user may replace a depleted supply roll 114 with a replacement supply roll.

The housing 120 has an outer surface adapted to be manually grasped, a supply roll hub 123 having an arcuate periphery and axially spaced ends. The inner surface 116 of the supply core 115 is journaled on the periphery of the supply roll hub 123, and the dispenser 100 includes a mechanism for restricting free rotation of the supply roll 14 about the supply roll hub 123 similar to the mechanism for the dispenser 10. Like the dispenser 10, preferably, a friction projection 124 is present to fictionally engage the inner surface of the supply core 115 to restrict free rotation of the supply roll 114.

Application means are present and comprise an application member 140 including an application surface 141 (e.g. a rectangular surface having a width of 1.91 centimeters or 0.75 inches). The application surface 41 forms a length of the path for the backing strip 17, and is adapted to engage the release material or low adhesion backsize surface 19 of the backing strip 17.

A take-up core 132 rotates about the take-up hub 131 in an advancing direction and has a portion of the backing strip 17 wound on its peripheral surfaces after application of the adhesive 12 to the substrate. Backlash of the backing strip 17 is reduced by including a friction brake 109 (FIG. 10) that engages surfaces of the take-up core 132 to restrict free rotation of the take-up core 132.

Path means define a path for the backing strip 17 from the supply roll hub 123 to the take-up hub 131. Preferably, the path means comprises a guide member 136 having a land surface 137 projecting from the housing 120.

An actuation member 144 is mounted for manually actuated reciprocal movement relative to the housing 120 between a projecting position (FIGS. 9 and 11) with a distal surface 146 projecting past the open end 126 of the housing 120 to afford positioning the application surface 141 opposite a substrate and a retracted position (FIG. 13) with the application surface 141 and the distal surface 146 of the actuation member 144 generally aligned so that the predetermined length of transfer adhesive 12 on the backing strip 17 may be pressed into contact with the substrate positioned opposite the application surface 141. The actuation member 144 is preferably constructed from a material similar to the material used to construct the member 44 and may include similar indicia.

The dispenser 100 has a different take-up assembly 130 than the dispenser 10. The take-up assembly 130 comprises the housing 120 having a take-up hub 131, and arcuate gear bearing surfaces 149 (e.g. cylindrical surfaces with the radially outer surfaces having an inner diameter of approximately 3.39 centimeters, 1.330 inches and with the radially inner surfaces having an outer diameter of approximately 1.69 centimeters, 0.666 inches).

The take-up assembly 130 includes a take-up core 132 and, the dispenser 100 includes an eccentric orbital gear system comprising a drive gear 102. The drive gear 102 is journaled on the arcuate gear bearing surfaces 149 and has a plurality of generally radially outwardly projecting drive ribs 154, and radially inwardly projecting teeth 155. The take-up assembly 130 includes a driven pinion gear 106 having an outer diameter of about 1.27 centimeters, 0.5 inches. The driven pinion gear 106 is attached to a take-up core 132 and has an axis offset from the axis of the gear bearing surfaces 149. The driven pinion gear 106 includes radially outwardly projecting teeth 107 adapted to engage the teeth 155 of the drive gear 102 to provide a gear ratio of approximately 2:1.

Figure 11:
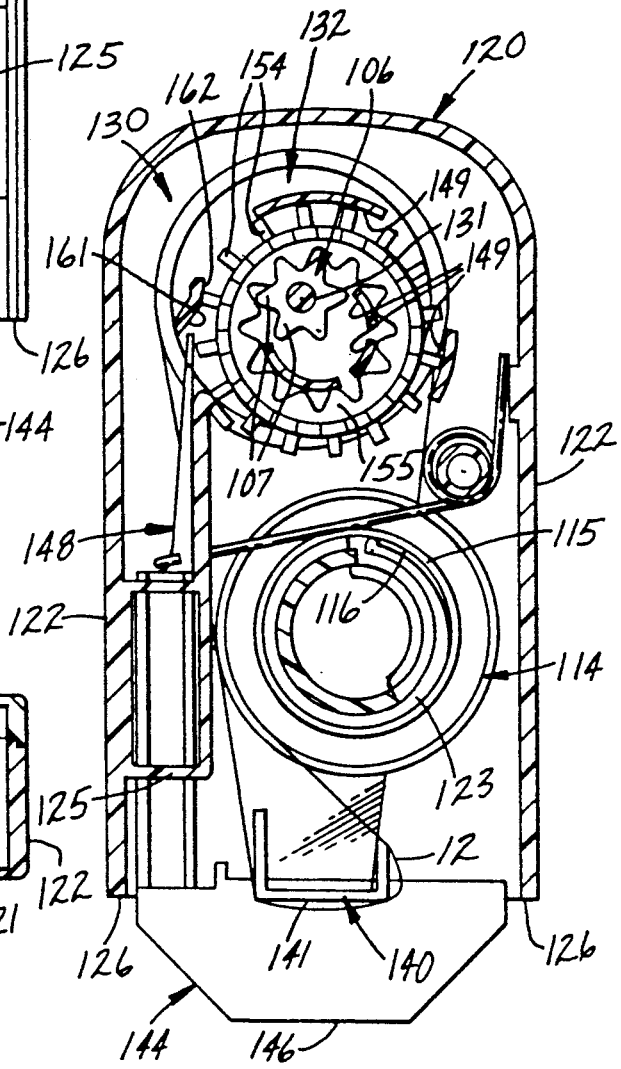

The take-up core 132 has arcuate inner surfaces and those inner surfaces are journaled on the peripheral surfaces of the take-up hub 131 (FIG. 11). Both the take-up core 132 and the drive gear 102 rotate about axis and those axis are spaced from one another.

Like the advancing means 48, the advancing means 148 is coupled between the actuation member 144 and the take-up assembly 130 for advancing the predetermined length of the backing strip 17 and the transfer adhesive 12 along the path to position the predetermined length of adhesive strip 17 along the application surface 41. Also, the advancing means 48 comprises a flexible elongate drive member 150 having a first end 151 attached to the actuation member 144 and a T-shaped second engagement end 152.

Unlike the dispenser 10, the dispenser 100 includes means mounting a drive member 150 on the housing to reciprocably move from (1) a release position with the second engagement end 152 spaced from the radially projecting drive ribs 154 to (2) an engage position between which release and engage positions the second engagement end 152 is adapted to engage one of the ribs 154 of the drive gear 102 which rotates the driven pinion gear 106 which in turn rotates the take-up core 132 to advance the length of the backing strip 17 and the transfer adhesive 12 a predetermined length along the path.

The dispenser 100 includes means such as a sleeve portion 125 of housing 120, which mounts the elongate drive member 150 on the housing 120 to reciprocably move relative to the housing 120 from (1) a release position with the second engagement end 152 spaced from the radially outward projecting drive ribs 154 to (2) an engage position between which release and engage positions the second engagement end 152 is adapted to engage one of the drive ribs 154 (FIG. 12) and rotate gear 102 which rotates gear 106 and take-up core 132 to advance the length of the backing strip 17 and the transfer adhesive 12 a predetermined length along the path. A detent surface on sleeve portion 125 fits into a groove surface on the drive member 150 to limit the movement of the drive member 150 relative to the housing 120.

Figure 12:
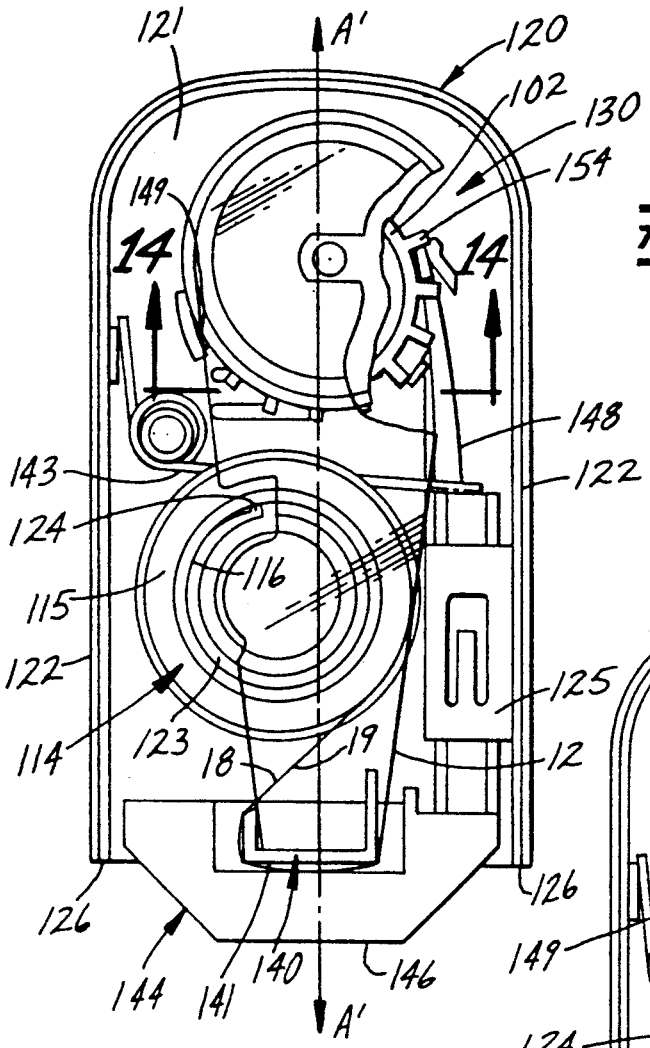
Figure 14:
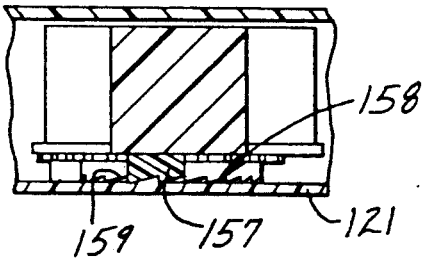
FIG. 14 is a sectional view of the dispenser of FIG. 9 taken approximately along line 14—14 of FIG. 12.

Also preferably the dispenser 10 includes biasing means such as a torsion spring 143 for biasing the actuation member 144 toward the projecting position. As best seen in FIG. 12, one end of the spring 143 is mounted on a shoulder in drive member 150 and the other end of the spring 143 is mounted to the housing 120.

Figure 13:
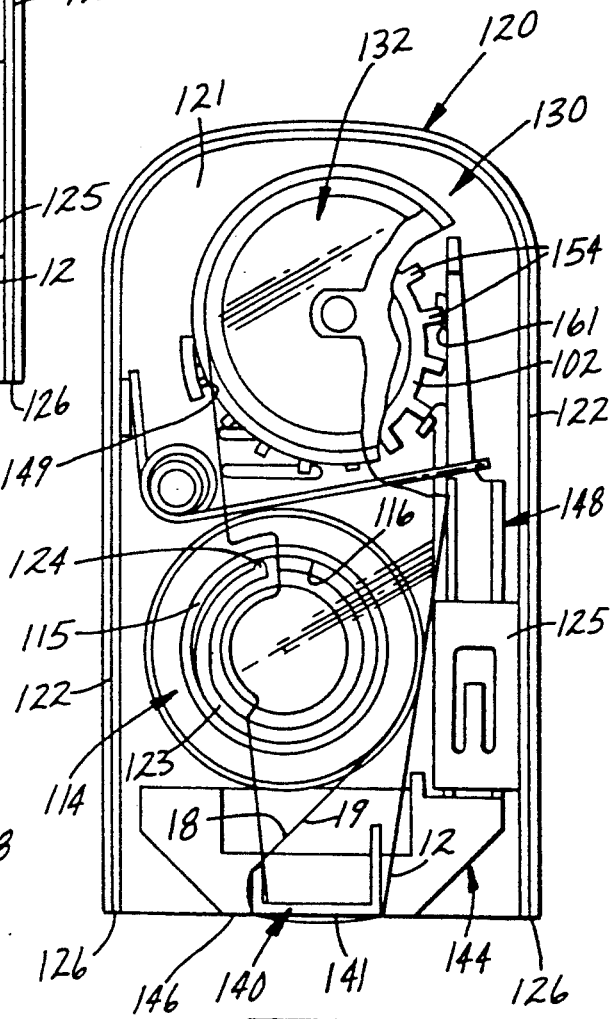

FIGS. 11 through 13 sequentially illustrate movement of the take-up assembly 130 and drive member 150 of the dispenser 100. When the actuation member 144 is moved from the projecting position toward the retracted position, the elongate drive member 150 moves from the release toward the engage position. A guide means such as an engagement shoulder is mounted on the housing 120 and comprises first 161 and second 162 portions. The first portion 161 of the shoulder engages a portion of the T-shaped end 152 and cams the T-shaped end 152 of the drive member 150 toward the drive ribs 154 and guides the end 152 into engagement with a drive rib 154 (FIG. 12). As the T-shaped end 152 is engaged with a rib 154 and moves along the first and second portions 161 and 162, the gear 102 rotates which in turn rotates gear 106 and take-up core 132. Rotation of take-up core 132 advances the backing 17 the predetermined length.

When the first portion 161 of the shoulder 156 cams the end 152 of the drive member 150 toward the drive ribs 154, the stiffness of the drive member 150 biases the end 152 away from the drive rib 154. Once the T-shaped end 152 of the drive member 150 passes the second portion 162, the stiffness of the member 150 causes the T-shaped end 152 to "spring" to the side of the shoulder 156 which is opposite the side facing ribs 154. After the T-shaped end 152 passes the second portion 162 of the shoulder 156, the shoulder 156 acts as a barrier to prevent engagement between the end 152 and the radially projecting drive ribs 154 when spring 143 causes the elongate drive member 150 to move back to the release position.

Optionally, the dispenser 100 may include arresting means to restrict backlash of the backing strip 17. The arresting means comprises the drive gear 102 having a ratchet 158 having specially shaped ratchet teeth 159, the housing 120 having a pawl 157 with a distal engagement end for engaging the specially shaped ratchet teeth 159 for arresting rotation of the drive gear 102 in a direction other than a direction which moves the take-up core 132 in the advancing direction and for affording intermittent movement of the take-up core 132 in the advancing direction.

OPERATION

The operation of the dispenser according to the present invention will now be described with reference to the first embodiment of dispenser 10. Initially a user manually grasps the housing 20 and selects a position on a substrate for application of a "spot" or predetermined length of adhesive 12. The user may look through transparent actuation member 44 to precisely position the dispenser 10 adjacent the substrate. The user then simply presses the housing 20 axially downward toward the substrate. Such manual pressing moves the housing 20 relative to the actuation member 44.

Upon movement of the actuation member 44 from the projecting (FIG. 4) toward the retracted position (e.g. by manually pressing the housing 20 downward toward the substrate), the advancing means 48 advances the predetermined length of the backing strip 17 and the transfer adhesive 12 along the path to position the predetermined length of adhesive strip along the application surface 41. The downward pressure on the housing 20 causes the application surface 41 to press against the substrate causing the transfer adhesive 12 to adhere to the substrate. Once the downward pressure on the housing 20 is released, the spring 43 biases the actuation member 44 from the retracted position to the projecting position, and the transfer adhesive 12 that was pressed against the substrate tears from the backing strip 17 and adheres to the substrate.

The present invention has now been described with reference to several embodiments thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

What is claimed is:

1. In combination, a definite length transfer adhesive dispenser for repeatedly applying a predetermined length of a transfer adhesive to a substrate, and a supply roll of said transfer adhesive comprising a supply core having inner and outer cylindrical surfaces and a through opening defined by the cylindrical inner surface, a length of backing strip wound around said core and having first and second major surfaces with said transfer adhesive releasably attached to said first major surface and with said second major surface coated with a release means;

said transfer adhesive dispenser comprising:

a housing having a housing axis, a base wall, side walls, and surfaces defining an open end, an inner surface and an outer surface adapted to be manually grasped, a supply roll hub having a supply hub axis, an arcuate periphery about said supply hub axis and axially spaced ends, one of said ends being fixed to said base wall with the axis of the supply hub being generally perpendicular to the axis of the housing, said inner surface of said supply core being journaled on said periphery of said supply roll hub, and said dispenser including means for restricting free rotation of said supply roll about said hub, a take-up assembly comprising:

a take-up hub having an axis, an arcuate periphery about said take up hub axis, and axially spaced ends, one of said ends being fixed to said base wall with the axis of the take-up hub being generally perpendicular to the axis of the housing, and a take-up core having inner surfaces journaled on said periphery of said take-up hub and having a portion of said backing strip wound thereon after application of said transfer adhesive to the substrate, said take-up core adapted to rotate about said take-up hub in an advancing direction;

path means defining a path for said backing strip from said supply roll to said take-up core, application means generally adjacent the open end of said housing comprising an application member including an application surface having a first end fixed to said base wall and a second end remote from said base wall and being situated in a plane generally perpendicular to said axis of said housing and forming a length of said path for said backing strip, said application surface being adapted to engage a predetermined length of the second major surface of said backing strip to generally define the predetermined length of the transfer adhesive;

an actuation member having a distal surface and being mounted for manually actuated reciprocal movement relative to said housing in a direction generally parallel to said housing axis being a projecting position with said distal surface projecting past said open end of said housing to afford positioning the application surface opposite the substrate and a retracted position with said application surface and said distal surface of said actuation member generally aligned so that the predetermined length of transfer adhesive on the backing strip may be pressed into contact with the substrate positioned opposite said application surface, and advancing means between said actuation member and said take-up assembly for advancing said predetermined length of said backing strip and transfer adhesive along said path to position said predetermined length of backing strip along said application surface, so that upon movement of said actuation member from said projecting position to said retracted position, said advancing means advances the predetermined length of said backing strip and transfer adhesive along said path to position said predetermined length of said backing strip and transfer adhesive along said application surface, and the application surface may be pressed against the substrate to cause the transfer adhesive to adhere to the substrate and upon movement of the actuation member from the retracted position to the projecting position, the transfer adhesive that was pressed against the substrate tears from the backing strip.

2. A combination according to claim 1 wherein said path means comprises a guide member having a land surface projecting from said base wall and having a first end fixed to said base wall and a second end remote from said base wall and defining a length of said path for said backing strip.

3. A combination according to claim 1 wherein said advancing means comprises an elongate drive member having a first end attached to said actuation means and a second engagement end, said take-up core being generally cylindrically-shaped and having a plurality of generally radially projecting drive ribs, means mounting said elongate drive member on said housing to reciprocably move between a release position with said second engagement end spaced from said radially projecting drive ribs and an engage position between which release and engage positions said second engagement end is adapted to engage one of said drive ribs and rotate said take-up core to advance said length of said backing strip and said transfer adhesive a predetermined length along said path, wherein when said actuation member is moved from said projecting position to said retracted position, said elongate drive member moves from said release to said engage position, and guide means mounted on said housing for guiding said engagement end of said drive member into engagement with one of said drive ribs upon movement of said drive member from said release toward said engage position and for preventing engagement between said engagement end and said drive ribs when said elongate drive member moves from said engage position toward said release position.

4. A combination according to claim 1 wherein said dispenser includes biasing means for biasing said actuation member toward said projecting position.

5. A combination according to claim 1 wherein said means for restricting free rotation of said supply roll about said supply roll hub comprises: said supply roll hub being a generally flexible arcuate member that is radially movable between a relaxed position where the supply roll hub has a diameter generally slightly greater than the diameter of the inner surface of the supply core, and a loaded position with the supply core journaled on the supply roll hub with the peripheral surface of the supply roll hub in frictional engagement with the inner surface of the supply core to restrict movement of the supply core until said advancing means moves said backing strip, wherein the stiffness of the supply roll hub biases the peripheral surface of the supply roll hub into frictional engagement with the inner surface of the supply core when the supply roll hub is in the loaded position.

6. A combination according to claim 1 wherein said dispenser includes arresting means comprising:

said take-up core having a ratchet having specially shaped ratchet teeth attached thereto, said housing having a pawl attached thereto and having a distal engagement end for engaging the specially shaped ratchet teeth for arresting rotation of said take-up core in a direction other than said advancing direction and for affording intermittent movement of said take-up core in the advancing direction, wherein said arresting means restricts backlash of said backing strip.

7. A combination according to claim 1 wherein the adhesive is comprised of an adhesive which cleanly breaks from the backing.

8. A combination according to claim 1 wherein the adhesive is comprised of at least about 70 parts microsphere adhesive and at least about 30 parts film forming adhesive.

9. A combination according to claim 1 wherein the adhesive comprises about 90 parts microsphere adhesive and about 10 parts film forming adhesive.

10. A combination according to claim 1 wherein the application member is fixedly attached to said housing so that the application member is free of movement relative to said housing.

11. In combination, a definite length transfer adhesive dispenser for repeatedly applying a predetermined length of a transfer adhesive to a substrate, and a supply roll of said transfer adhesive comprising a supply core having inner and outer cylindrical surfaces and a through opening defined by the cylindrical inner surface, a length of backing strip wound around said core and having first and second major surfaces with said transfer adhesive releasably attached to said first major surface and with said second major surface coated with a release means;

said transfer adhesive dispenser comprising:

a housing having a housing axis, a base wall, side walls, and surfaces defining an open end, an inner surface and an outer surface adapted to be manually grasped, a supply roll hub having a supply hub axis, an arcuate periphery about said supply hub axis and axially spaced ends, one of said ends being fixed to said base wall with the axis of the supply hub being generally perpendicular to the axis of the housing, said inner surface of said supply core being journaled on said periphery of said supply roll hub, and said dispenser including means for restricting free rotation of said supply roll about said hub, a take-up assembly comprising:

a take-up hub having an axis, an arcuate periphery about said take up hub axis, and axially spaced ends, one of said ends being fixed to said base wall with the axis of the take-up hub being generally perpendicular to the axis of the housing, and a take-up core having inner surfaces journaled on said periphery of said take-up hub and having a portion of said backing strip wound thereon after application of said transfer adhesive to the substrate, said take-up core adapted to rotate about said take-up hub in an advancing direction;

path means defining a path for said backing strip from said supply roll to said take-up core, application means generally adjacent the open end of said housing comprising an application member including an application surface having a first end fixed to said base wall and a second end remote from said base wall and being situated in a plane substantially perpendicular to said axis of said housing and forming a length of said path for said backing strip, said application surface being adapted to engage a predetermined length of the second major surface of said backing strip to generally define the predetermined length of the transfer adhesive;

an actuation member having a distal surface and being mounted for manually actuated reciprocal movement relative to said housing in a direction generally parallel to said housing axis between a projecting position with said distal surface projecting past said open end of said housing to afford positioning the application surface opposite the substrate and a retracted position with said application surface and said distal surface of said actuation member generally aligned so that the predetermined length of transfer adhesive on the backing strip may be pressed into contact with the substrate positioned opposite said application surface, advancing means for advancing said predetermined length of said backing strip and transfer adhesive along said path to position said predetermined length of backing strip along said application surface, so that upon movement of said actuation member from said projecting position to said retracted position, said advancing means advances the predetermined length of said backing strip and transfer adhesive along said path to position said predetermined length of said backing strip and transfer adhesive along said application surface, and the application surface may be pressed against the substrate to cause the transfer adhesive to adhere to the substrate and upon movement of the actuation member from the retracted position to the projecting position, the transfer adhesive that was pressed against the substrate tears from the backing strip, wherein said advancing means comprises:

an elongate drive member having a first end attached to said actuation means and a second engagement end, said dispenser includes arcuate gear bearing surfaces having an axis and projecting from said base wall in a direction generally perpendicular to the axis of said housing, and said take-up assembly includes an eccentric orbital gear system comprising a drive gear journaled on said arcuate gear bearing surfaces and having a plurality of generally radially outwardly projecting drive ribs, and radially inwardly projecting teeth, a driven pinion gear attached to said take-up core and having an axis offset from the axis of the gear bearing surfaces and radially outwardly projecting teeth adapted to engage the teeth of the drive gear.

12. A combination according to claim 11 wherein said advancing means comprises:

means mounting said elongate drive member on said housing for reciprocal movement between a release position with said second engagement end spaced form said radially projecting drive ribs and an engage position between which release and engage positions said second engagement end is adapted to engage one of said ribs of said drive gear which rotates said driven pinion gear which in turn rotates said take-up core to advance said length of said backing strip and said transfer adhesive a predetermined length along said path, wherein when said actuation member is moved from said projecting position to said retracted position, said elongate drive member moves from said release to said engage position, and guide means mounted on said housing for guiding said engagement end of said drive member into engagement with one of said drive ribs upon movement of said drive member from said release toward said engage position and for preventing engagement between said engagement end and said drive ribs when said elongate drive member moves from said engage position toward said release position.

13. A combination according to claim 11 wherein said dispenser includes arresting means comprising:

said drive gear having a ratchet having specially shaped ratchet teeth attached thereto, said housing having a pawl attached thereto and having a distal engagement end for engaging the specially shaped ratchet teeth for arresting rotation of said drive gear in a direction other than a direction which moves said take-up core in said advancing direction and for affording intermittent movement of said take-up core in the advancing direction, wherein said arresting means restricts backlash of said backing strip.

14. A definite length transfer adhesive dispenser for repeatedly applying a predetermined length of a transfer adhesive to a substrate from a supply roll of said transfer adhesive, the supply roll comprising a length of backing strip having first and second major surfaces with the transfer adhesive releasably attached to the first major surface and with the second major surface having a release means;

said transfer adhesive dispenser comprising:

an elongate housing defining a housing axis, the housing having an open end, an inner surface, and an outer surface adapted to be manually grasped, a supply roll hub for receiving the supply roll;

a take-up assembly comprising:

a take-up hub having an axis, the take-up hub having surfaces adapted to receive a take-up core that has a portion of the backing strip wound thereon after application of the transfer adhesive to the substrate, the take-up core adapted to move in an advancing direction;

path means defining a path for the backing strip from the supply roll to the take-up core, an application member including an application surface forming a length of the path for the backing strip, said application surface being adapted to engage a predetermined length of the second major surface of the backing strip to generally define the predetermined length of transfer adhesive;

an actuation member having a distal surface, the actuation member being mounted for manually actuated reciprocal movement relative to said housing in a direction generally parallel to said housing axis between a projecting position with said distal surface projecting beyond said open end of said housing to afford positioning the application surface opposite the substrate and a retracted position with said application surface and said distal surface of said actuation member generally aligned so that the predetermined length of transfer adhesive on the backing strip may be pressed into contact with the substrate positioned opposite said application surface, and an advancer for advancing said predetermined length of said backing strip and transfer adhesive along said path to position said predetermined length of said backing strip along said application surface, so that upon movement of said actuation member from said projecting position to said retracted position, said advancer advances the predetermined length of said backing strip and said transfer adhesive along said path to position said predetermined length of said backing strip and transfer adhesive along said application surface, and the application surface may be pressed against the substrate to cause the transfer adhesive to adhere to the substrate and upon movement of the actuation member from the retracted position to the projecting position, the transfer adhesive that was pressed against the substrate tears from the backing strip.

15. A definite length transfer adhesive dispenser according to claim 14 wherein said application surface is situated in a plane generally perpendicular to said axis of said housing, and the application member is fixedly attached to said housing so that the application member is free of movement relative to said housing.

16. A definite length transfer adhesive dispenser according to claim 14 wherein the advancer comprises an elongate drive member having a first end attached to said actuation member and an engagement end, said take-up core having a plurality of drive ribs, means mounting said elongate drive member on said housing to reciprocably move between a release position with the engagement end spaced from said drive ribs and an engage position between which release and engage positions said engagement end is adapted to engage one of said drive ribs and move the take-up core to advance the length of said backing strip and transfer adhesive the predetermined length along said path, wherein when said actuation member is moved from said projecting position to said retracted position, said elongate drive member moves from said release to said engage position, and a guide mounted on said housing for guiding said engagement end of said drive member into engagement with one of said drive ribs upon movement of said drive member from said release toward said engage position and for preventing engagement between said engagement end and said drive ribs when said elongate drive member moves from said engage position toward said release position.

17. A dispenser according to claim 14 wherein said path means comprises a guide member having a land surface projecting from said base wall and having a first end fixed to said housing and a second end remote from said housing wall and defining a length of said path for said backing strip.

18. A dispenser according to claim 14 wherein the actuation member moves linearly relative to said housing.

19. A dispenser according to claim 14 wherein the inner surface of the housing define an interior, and all portions of the backing strip wound on the take-up hub after application of the adhesive to the substrate are situated within the interior of the housing.

20. A definite length transfer adhesive dispenser for repeatedly applying a predetermined length of a transfer adhesive to a substrate from a supply roll of said transfer adhesive, the supply roll comprising a length of backing strip having first and second major surfaces with the transfer adhesive releasably attached to the first major surface and with the second major surface having a release means;

said transfer adhesive dispenser comprising:

an elongate housing defining a housing axis, the housing having an open end, an inner surface, and an outer surface adapted to be manually grasped, a supply roll hub for receiving the supply roll;

a take-up assembly comprising:

a take-up hub having an axis, the take-up hub having surfaces adapted to receive a take-up core that has a portion of the backing strip wound thereon after application of the transfer adhesive to the substrate, the take-up core adapted to move in an advancing direction;

path means defining a path for the backing strip from the supply roll to the take-up core, an application member including an application surface forming a length of the path for the backing strip, said application surface being adapted to engage a predetermined length of the second major surface of the backing strip to generally define the predetermined length of transfer adhesive;

an actuation member having a distal surface, the actuation member being mounted for manually actuated reciprocal movement relative to said housing in a direction substantially parallel to said housing axis between a projecting position with said distal surface projecting beyond said open end of said housing to afford positioning the application surface opposite the substrate and a retracted position with said application surface and said distal surface of said actuation member generally aligned so that the predetermined length of transfer adhesive on the backing strip may be pressed into contact with the substrate positioned opposite said application surface, an advancer between said actuation member and the take-up assembly for advancing said predetermined length of said backing strip and transfer adhesive along said path to position said predetermined length of said backing strip along said application surface, so that upon movement of said actuation member from said projecting position to said retracted position, said advancer advances the predetermined length of said backing strip and said transfer adhesive along said path to position said predetermined length of said backing strip and transfer adhesive along said application surface, and the application surface may be pressed against the substrate to cause the transfer adhesive to adhere to the substrate and upon movement of the actuation member from the retracted position to the projecting position, the transfer adhesive that was pressed against the substrate tears from the backing strip, wherein said advancer comprises an elongate drive member having a first end attached to said actuation members and an engagement end, said dispenser includes arcuate gear bearing surfaces projecting from said housing, and said take-up assembly includes an eccentric orbital gear system comprising a drive gear journaled on said arcuate gear bearing surfaces and having a plurality of outwardly projecting drive ribs, and radially inwardly projecting teeth, a driven pinion gear attached to said take-up core and having radially outwardly projecting teeth adapted to engage the teeth of the drive gear.

21. A dispenser according to claim 20 wherein:

said advancer comprises means mounting said elongate drive member on said housing for reciprocal movement between a release position with said second engagement end spaced from said outwardly projecting drive ribs and an engage position between which release and engage positions said engagement end is adapted to engage one of said ribs of said drive gear which rotates said driven pinion gear which in turn rotates said take-up core to advance said length of said backing strip and said transfer adhesive a predetermined length along said path, wherein when said actuation member is moved from said projecting position to said retracted position, said elongate drive member moves from said release to said engage position, and guide means mounted on said housing for guiding said engagement end of said drive member into engagement with ne of said drive ribs upon movement of said drive member from said release toward said engage position and for preventing engagement between said engagement end and said drive ribs when said elongate drive member moves from said engage position toward said release position.

22. A definite length transfer adhesive dispenser for repeatedly applying a predetermined length of a transfer adhesive to a substrate from a supply roll of said transfer adhesive, the supply roll comprising a length of backing strip having first and second major surfaces with the transfer adhesive releasably attached to the first major surface and with the second major surface having a release means;

said transfer adhesive dispenser comprising:

an elongate housing having an open end, an inner surface defining an interior, and an outer surface adapted to be manually grasped, a supply roll hub for receiving the supply roll;

a take-up assembly comprising:

a take-up hub having surfaces adapted to receive a take-up core that has a portion of the backing strip wound thereon after application of the transfer adhesive to the substrate, the take-up core adapted to move in an advancing direction;

path means defining a path for the backing strip from the supply roll to the take-up core, an application member including an application surface forming a length of the path for the backing strip, said application surface being adapted to abut a predetermined length of the second major surface of the backing strip to substantially define the predetermined length of transfer adhesive;

an actuation member having a distal surface, the actuation member being mounted for manually actuated reciprocal movement relative to said housing between a projecting position with said distal surface projecting beyond said open end of said housing to afford positioning the application surface opposite the substrate and a retracted position with said application surface and said distal surface of said actuation member generally aligned so that the predetermined length of transfer adhesive on the backing strip may be pressed into contact with the substrate positioned opposite said application surface, and an advancer for advancing said backing strip and transfer adhesive along said path to position said predetermined length of said backing strip along said application surface, so that upon movement of said actuation member from said projecting position to said retracted position, said advancer advances the predetermined length of said backing strip and said transfer adhesive along said path to position said predetermined length of said backing strip and transfer adhesive along said application surface, and the application surface may be pressed against the substrate to cause the transfer adhesive to adhere to the substrate and upon movement of the actuation member from the retracted position to the projecting position, the transfer adhesive that was pressed against the substrate tears from the backing strip, wherein all portions of the backing strip wound on the take-up hub after application of the adhesive to the substrate are situated within the interior of the housing.

23. A definite length transfer adhesive dispenser according to claim 22 wherein the application member is fixedly attached to said housing so that the application member is free of movement relative to said housing, said housing has an axis of elongation, and said application surface is situated in a plane generally perpendicular to said axis of elongation of said housing.

24. A definite length transfer adhesive dispenser according to claim 22 wherein the advancer comprises an elongate drive member having a first end attached to said actuation member and an engagement end, said take-up core having a plurality of drive ribs, means mounting said elongate drive member on said housing to reciprocally move between a release position with the engagement end spaced from said drive ribs and an engage position between which release and engage positions said engagement end is adapted to engage one of said drive ribs and move the take-up core to advance the length of said backing strip and transfer adhesive the predetermined length along said path, wherein when said actuation member is moved from said projecting position to said retracted position, said elongate drive member moves from said release to said engage position, and a guide mounted on said housing for guiding said engagement end of said drive member into engagement with one of said drive ribs upon movement of said drive member from said release toward said engage position and for preventing engagement between said engagement end and said drive ribs when said elongate drive member moves from said engage position toward said release position.

25. A combination according to claim 22 wherein said advancer comprises an elongate drive member having a first end attached to said actuation members and an engagement end, said dispenser includes arcuate gear bearing surface projecting from said housing, and said take-up assembly includes an eccentric orbital gear system comprising a drive gear journaled on said arcuate gear bearing surfaces and having a plurality of outwardly projecting drive ribs, and radially inwardly projecting teeth, a driven pinion gear attached to said take-up core and having radially outwardly projecting teeth adapted to engage the teeth of the drive gear.

26. A dispenser according to claim 25 wherein:

said advancer comprises means mounting said elongate drive member on said housing for reciprocal movement between a release position with said second engagement end spaced from said outwardly projecting drive ribs and an engage position between which release and engage positions said engagement end is adapted to engage one of said ribs of said drive gear which rotates said driven pinion gear which in turn rotates said take-up core to advance said length of said backing strip and said transfer adhesive a predetermined length along said path, wherein when said actuation member is moved from said projecting position to said retracted position, said elongate drive member moves from said release to said engage position, and guide means mounted on said housing for guiding said engagement end of said drive member into engagement with one of said drive ribs upon movement of said drive member from said release toward said engage position and for preventing engagement between said engagement end and said drive ribs when said elongate drive member moves from said engage position toward said release position.

27. A dispenser according to claim 22 wherein said path means includes a guide member having a land surface projecting from said base wall and having a first end fixed to said housing and a second end remote from said housing wall and defining a length of said path for said backing strip.

28. A dispenser according to claim 22 wherein said housing has an axis of elongation, and the actuation member moves linearly relative to said axis of elongation of said housing.

29. A dispenser according to claim 28 wherein said advancer comprises an elongate drive member having a first end attached to said actuation members and an engagement end, said dispenser includes arcuate gear bearing surfaces projecting from said housing, and said take-up assembly includes an eccentric orbital gear system comprising a drive gear journaled on said arcuate gear bearing surfaces and having a plurality of outwardly projecting drive ribs, and radially inwardly projecting teeth, a driven pinion gear attached to said take-up core and having radially outwardly projecting teeth adapted to engage the teeth of the drive gear.

30. A dispenser according to claim 22 wherein said dispenser includes arresting means comprising:

said take-up core having a ratchet having specially shaped ratchet teeth attached thereto, said housing having a pawl attached thereto and having a distal engagement end for engaging the specially shaped ratchet teeth for arresting rotation of said take-up core in a direction other than said advancing direction and for affording intermittent movement of said take-up core in the advancing direction, wherein said arresting means restricts backlash of said backing strip.

* * * * *

UNITED STATES PATENT AND TRADEMARK OFFICE

CERTIFICATE OF CORRECTION

PATENT NO. : 5,316,613

DATED : May 31, 1994

INVENTOR(S) : Samuelson et al.

It is certified that error appears in the above-indentified patent and that said Letters Patent is hereby corrected as shown below:

Column 21, line 48, delete "surface" and insert --surfaces--.

Signed and Sealed this

Fourth Day of July, 1995

Bruce Lehman

*Attest:*

BRUCE LEHMAN

*Attesting Officer*

*Commissioner of Patents and Trademarks*